US005359859A

United States Patent [19]

Bench et al.

[11] Patent Number: 5,359,859

[45] Date of Patent: Nov. 1, 1994

[54] METHOD AND APPARATUS FOR RECOVERING REFRIGERANTS

[75] Inventors: William J. Bench, Holland, Mich.; Donald J. Bench, Sun City Center, Fla.; Gary L. Molenaar, Hamilton, Mich.

[73] Assignee: Russell Technical Products, Holland, Mich.

[21] Appl. No.: 996,125

[22] Filed: Dec. 23, 1992

[51] Int. Cl.[5] ..... F25B 47/00

[52] U.S. Cl. ..... 62/85; 62/77; 62/292; 62/475

[58] Field of Search ..... 62/77, 85, 749, 195, 62/292, 475

[56] References Cited

U.S. PATENT DOCUMENTS 3,021,689 2/1962 Miller .
4,169,356 10/1979 Kingham .
4,285,206 8/1981 Koser .
4,364,236 12/1982 Lower et al. .
4,476,688 10/1984 Goddard .
4,554,792 11/1985 Margulefsky et al. .
4,766,733 8/1988 Scuderi .
4,805,416 2/1989 Manz et al. ..... 62/85
4,809,515 3/1989 Houwink .
4,862,699 9/1989 Lounis .
4,887,435 12/1989 Anderson, Jr. .
4,969,495 11/1990 Grant .
4,981,020 1/1991 Scuderi .
4,982,576 1/1991 Proctor et al. .
5,024,061 6/1991 Pfeil, Jr. et al. .
5,031,410 7/1991 Plzak et al .
5,036,675 8/1991 Anderson, Jr. .
5,038,578 8/1991 Manz et al. .
5,086,630 2/1992 Van Steenburgh, Jr. .
5,094,087 3/1992 Gramkow .
5,123,259 6/1992 Morgan, Sr. .
5,127,239 7/1992 Manz et al. ..... 62/77

*Primary Examiner*—John M. Sollecito
*Attorney, Agent, or Firm*—Price, Heneveld, Cooper, DeWitt & Litton

[57] ABSTRACT

A method and apparatus for recovering, reclaiming and/or recycling refrigerants, including receiving the chlorinated flurocarbon refrigerant into the apparatus at a regulated pressure, cleaning the refrigerant to provide a substantially pure chlorinated flurocarbon refrigerant, and compressing the refrigerant to form a high-pressure, high-temperature gaseous phase refrigerant. The gaseous phase refrigerant is condensed to a liquid low-temperature refrigerant by sequentially passing the gaseous refrigerant through a first and second heat exchanger. The second heat exchanger extracts the heat from the gaseous refrigerant through an evaporator of a high stage refrigeration system. The condensed low-temperature refrigerant is transported and deposited in a storage cylinder. To recycle the refrigerant, the liquid refrigerant is drawn from the storage cylinder and transformed from a liquid phase to a gaseous phase by absorbing heat produced by the high stage refrigeration system. The low pressure, low-temperature gaseous refrigerant is then rerouted through the cleansing assembly and compressed to form a high-pressure, high-temperature vapor. The vapor is then recondensed by passing it through a heat exchange assembly and returned as a liquid to the storage cylinder.

17 Claims, 5 Drawing Sheets

METHOD AND APPARATUS FOR RECOVERING REFRIGERANTS

FIELD OF THE INVENTION

This invention relates to a method and apparatus for recovering refrigerants, and particularly to a method and apparatus for reclaiming and recycling both high-temperature and low-temperature refrigerants.

BACKGROUND OF THE INVENTION

A majority of air conditioning and refrigeration systems use chlorinated flurocarbons (CFCs) as the working refrigerant fluid. When such systems required repair or servicing, it was not uncommon for the repairman to discharge the refrigerant in the system to the atmosphere. Once the servicing or repairs were completed, new refrigerant was added to the system. Because of recent concerns for the environment, it has become illegal in may countries to discharge CFC refrigerants to the atmosphere. It has also become desirable, and in many cases mandated by law, to reclaim and recycle CFC refrigerants.

Environmental concerns are not the only factor in favor of recycling and reusing refrigerants. In recent years, the cost of refrigerants has escalated drastically, having doubled or tripled in the past decade. For this reason, it is not only desirable to remove the refrigerant from a unit prior to service, but to extract as much refrigerant vapor from the unit as is possible to maximize recovery.

It is also desirable that a refrigerant recovery system be portable. Air conditioning systems are typically located on the roof of a building, and any refrigerant recovery apparatus must be transported to the roof in order to be attached to the air conditioning unit. Some prior refrigerant recovery machines use water or air to cool the refrigerant as it is being removed from the air conditioning unit. Recovery machines which require a source of water for their operation are unusable atop buildings that lack a water supply on the roof. Machines which use air to cool the refrigerant may take a substantially long period to remove the refrigerant from an air conditioning unit since temperatures may be in excess of 100° F. on the roof, imposing a great cooling burden on what must necessarily be a small portable apparatus.

Other known methods of refrigerant recovery use refrigerant from the air conditioning unit itself, cooled by the air conditioning unit, to cool the refrigerant being removed. Obviously, such methods require that the air conditioning unit be operational to remove refrigerant therefrom, and are incapable of removing refrigerant from a poorly operating air conditioning unit, even though such an inoperative unit is the most likely candidate for refrigerant removal. Thus, it is highly desirable that a refrigerant recovery system and method be self contained and operate unassisted by the refrigeration system being serviced. Also, the cooling ability of water- or air-cooled refrigeration systems is constrained, as neither can cool refrigerant below the temperature of the water or air employed as a heat transfer medium.

SUMMARY OF THE INVENTION

One aspect of the instant invention is to provide a method and apparatus for recovering, reclaiming and/or recycling refrigerants. Another aspect of the invention is to transform low-temperature refrigerants from a gaseous state into a low-temperature liquid state for temporary storage in a cylinder, thus maximizing the recovery, reclaiming and/or recycling ability of the system. Yet another aspect of the invention is to provide a system which removes the refrigerant from a non-functioning refrigeration system. Still another aspect of the invention is to provide a method and apparatus for cleansing the recovered refrigerant and recycle it for introduction back into the unit being serviced.

In one embodiment, the method for recovering, reclaiming and recycling a refrigerant includes receiving the refrigerant in a gaseous state from a source. The refrigerant is passed through a series of filters to remove any detrimental or undesirable compounds before being compressed into a pressurized and heated vapor. Heat is removed from the vapor by passing it through a series of heat exchangers, the second of which is in heat exchange relationship with a high stage refrigeration system. In the second heat exchanger, the pressurized vapor refrigerant is condensed to a pressurized liquid refrigerant which is then stored in a chilled container. The method further includes the steps of reclaiming the stored refrigerant in the chilled container by sealing the container and sending it to the manufacturer or third party who will reclaim the refrigerant. In the alternative, and in addition, the method includes steps for recycling the refrigerant in the chilled container including drawing the liquid refrigerant from the container and converting it to a gas by adding heat thereto. The gas is then cleansed by successively passing the refrigerant through a cleansing assembly, reconverting the gaseous refrigerant to a liquid by routing it through the first and second heat exchangers and temporarily storing the liquid in the chilled container.

In one embodiment, the apparatus for recovering, reclaiming and recycling the refrigerant includes means for receiving the refrigerant from a source in a gaseous phase and at a regulated pressure, a cleansing assembly and a means for compressing the gaseous refrigerant to a high-pressure, high-temperature gaseous refrigerant in series fluid communication with the receiving means. The compressing means is in fluid communication with a heat exchange assembly wherein the high-pressure, high-temperature gaseous refrigerant is sequentially transformed to a high-pressure, low-temperature liquid refrigerant. The heat exchange assembly is coupled in fluid communication with a means for temporarily storing the liquid refrigerant. In another form, the apparatus includes an assembly for relieving excess pressure in the high-pressure, high-temperature gaseous refrigerant line and rerouting that refrigerant to the means for receiving the refrigerant in a gaseous phase at a regulated pressure.

Advantages provided by the instant invention include a method and apparatus for recovering, reclaiming and/or recycling low-temperature refrigerants, namely, R-13, R-23 and R-503, which are unable to be condensed to a liquid form using conventional air or water heat exchangers. Another advantage provided by this invention includes a method and apparatus for recovering and recycling refrigerants from systems containing a contaminant, such as moisture and/or burned and acidic lubricating oil. The method and apparatus provide a means for removing the moisture and contaminated oil from the refrigerant and storing the refrigerant for later reintroduction into the unit being serviced. The recovering recycling and/or reclaiming of CFC refrigerants substantially reduces environmental damage to the ozone layer, as well as reducing costs associated with replacing the refrigerant removed from the unit being serviced. Yet another advantage is that the method and apparatus may be used equally as well in recovering conventional refrigerants such as R-12, R-22, and R-502.

These and other objects, advantages, purposes and features of the invention will become more apparent from a study of the following description taken in conjunction with the drawing figures described below.

DETAILED DESCRIPTION OF THE PREFERRED EMBODIMENTS

Figure 1:
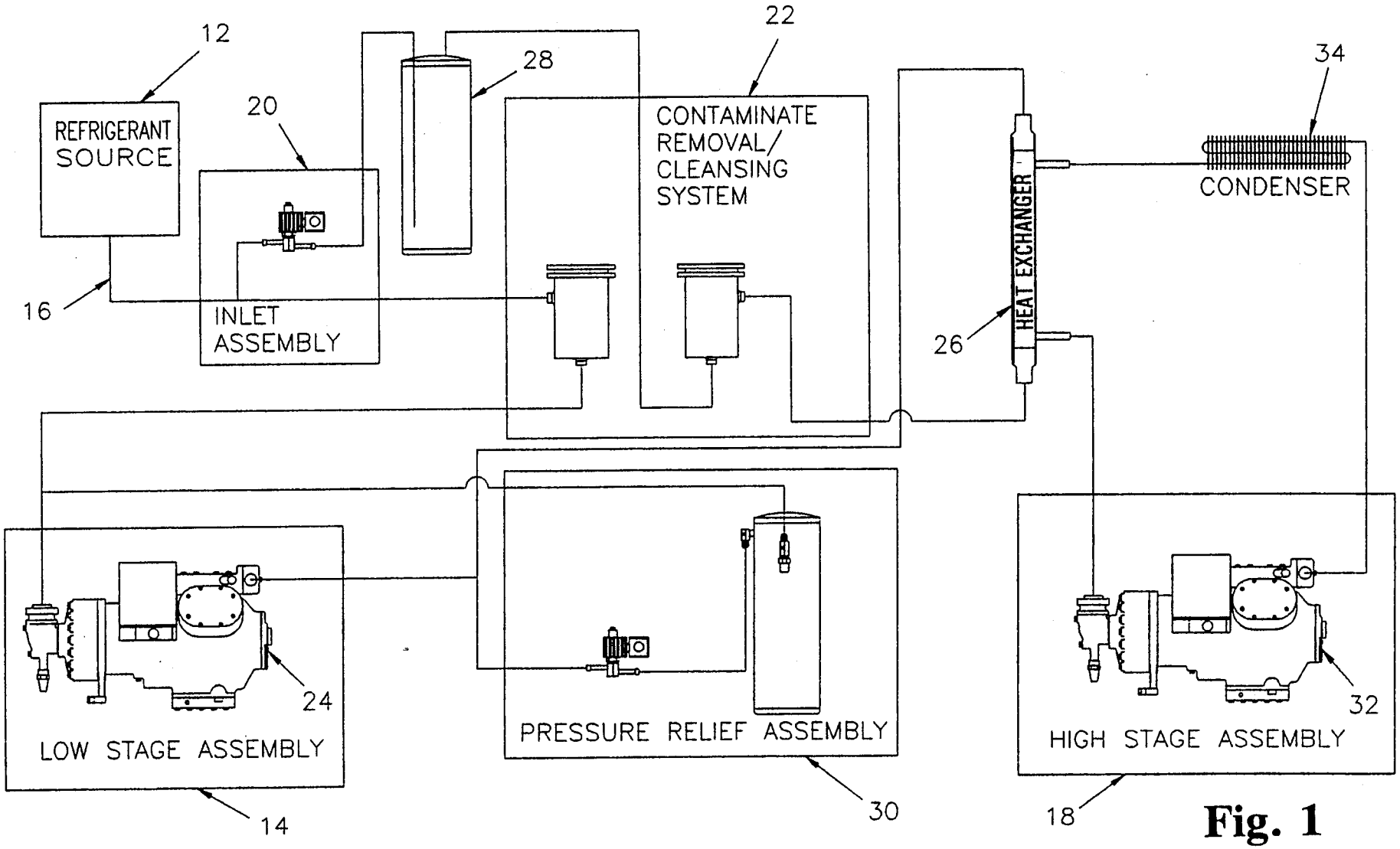
FIG. 1 is a generalized block diagram of a low-temperature refrigerant recovery and recycling system embodying the invention.

For purposes of the following description, the terms "upper," "lower," "right," "left," "rear," "front," "vertical," "horizontal" and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are not be be considered as limiting, unless the claims expressly state otherwise.

Referring to the drawing figures, FIG. 1 is a generalized block diagram of a refrigerant recovery, reclaiming and recycling system 10 for extracting refrigerants from a refrigeration system or other source of refrigerant 12. System 10 is designed to recover refrigerant from units being serviced and storing that refrigerant in a container for reintroduction to the system from which it was taken, or to be taken to a facility where the refrigerant can be reclaimed. Moreover, system 10 is designed to remove contaminants from the recovered refrigerant, thus offering a substantial savings over recharging the serviced unit with new refrigerant.

Recovery and recycling system (RRS) 10 generally includes a low stage assembly 14 which directly receives the refrigerant to be recovered, reclaimed or recycled from system/source 12 through coupling 16. Assembly 14 is closely associated and operably interrelated with high stage assembly 18. Depending upon the specific application, and more particularly upon the volume of refrigerant to be recovered, reclaimed or recycled, the size of RRS 10 will vary from small portable units up to and including systems which must be transported by a tractor trailer or equivalent mode of transportation. In a preferred embodiment, RRS 10 would be capable of handling quantities of refrigerant on the order of ten to forty pounds. A system of such capability could be easily mounted or transported in a pick-up truck or van and taken to the unit to be serviced.

Referring again to FIG. 1, low stage assembly 14 generally includes an inlet assembly 20 coupled in fluid communication with a contaminant removal or cleansing system 22 which, in turn, is in fluid communication with a compressor 24. As will be described in greater detail below, compressor 24 and inlet assembly 20 may be operated through a series of interacting switches and solenoid-operated valves to maintain internal pressure control, and shut down system 10 when any one of the processes has been completed. Compressor 24 is coupled in fluid communication with a heat exchange assembly 26 designed to condense the refrigerant. Heat exchange assembly 26, in turn, is connected in fluid communication with a reclaiming and/or recycling cylinder 28 which is also in fluid communication with inlet assembly 20. Inlet assembly 20 and cleansing system 22 are interconnected with heat exchange assembly 26 through a pressure relief system 30 designed to control the operating pressure of low stage assembly 14 without venting refrigerant to the atmosphere.

High stage assembly 18, shown in the right-hand side of FIG. 1 and comprising a portion of RRS 10, interacts in conjunction with low stage assembly 14 through heat exchange assembly 26. High stage assembly 18 includes a compressor 32 in fluid communication with a condensing assembly 34 which is coupled in fluid communication with heat exchange assembly 26 which is then coupled in fluid communication back to compressor 32. In the preferred embodiment, high stage assembly 18 functions as a standard refrigeration system well known in the industry using refrigerants generally designated R-12, R-22 and R-502.

Figure 2:
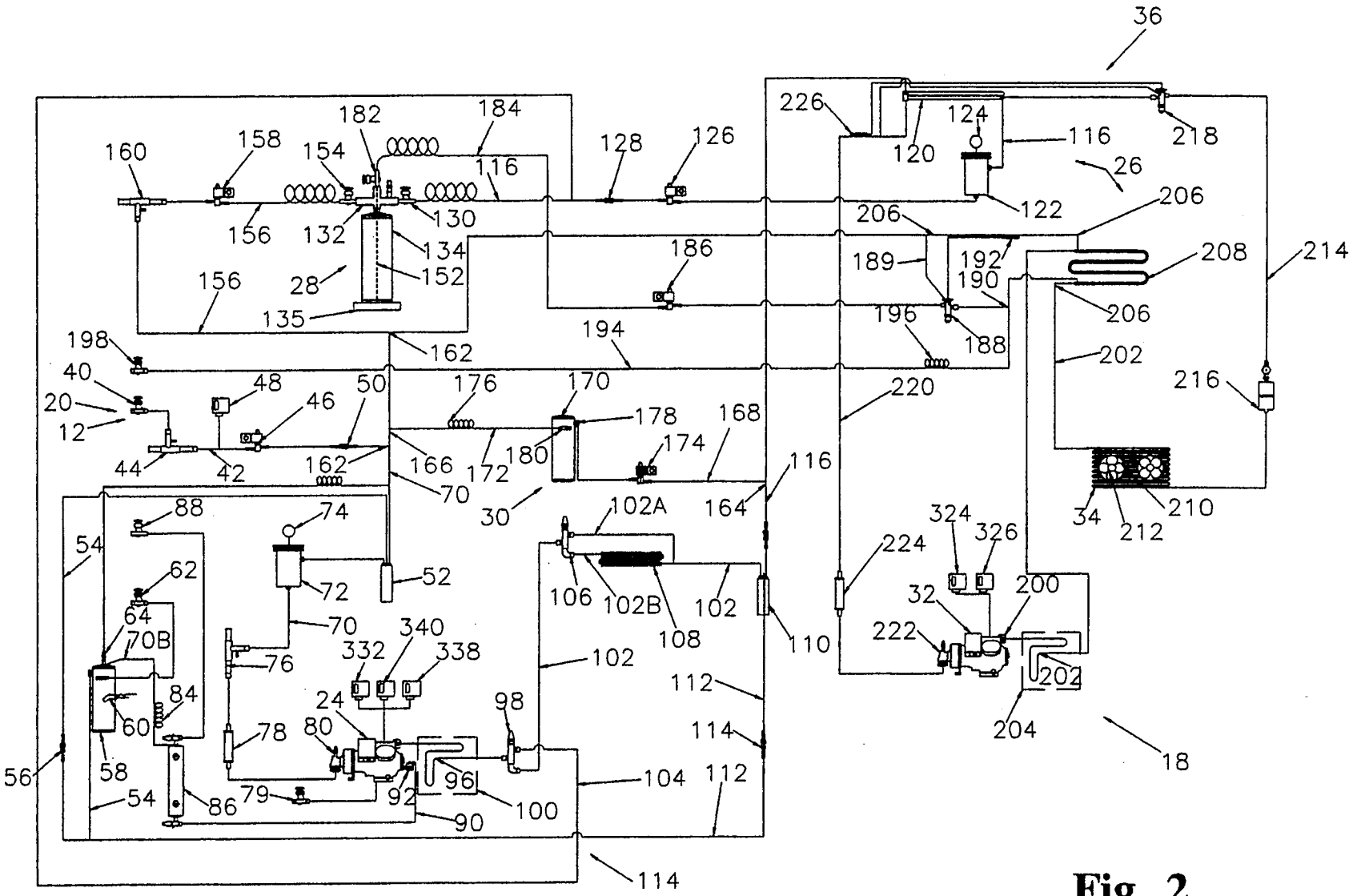
FIG. 2 is a schematic diagram illustrating a preferred embodiment of the recovery and recycling system of the invention.
Figure 3A:
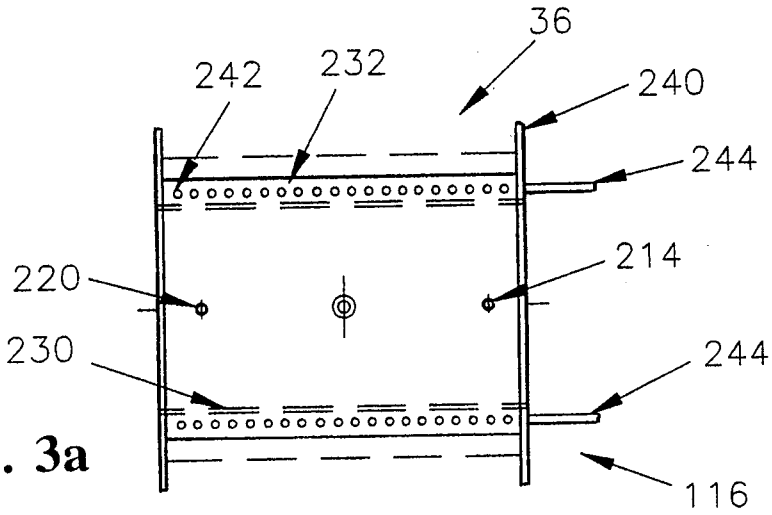
FIGS. 3A–3C are sectional views illustrating a preferred embodiment of one aspect of the invention.
Figure 3B:
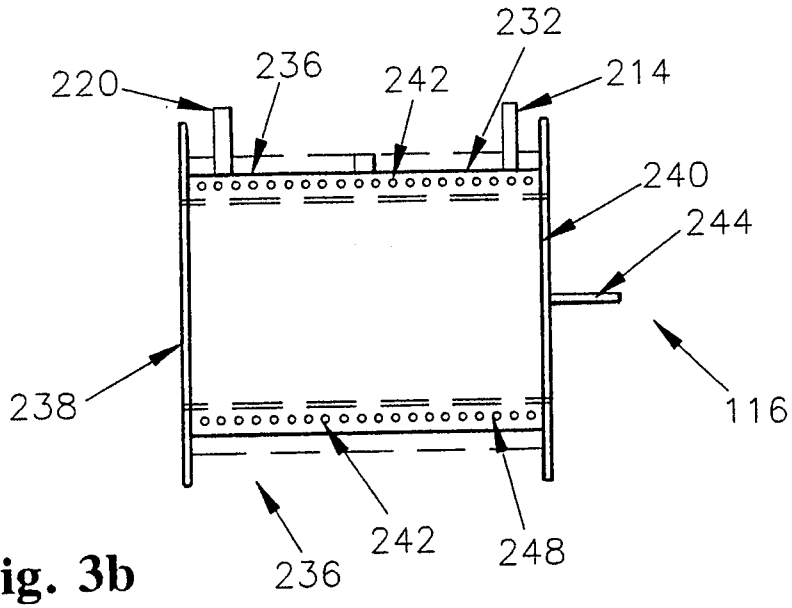
Figure 3C:
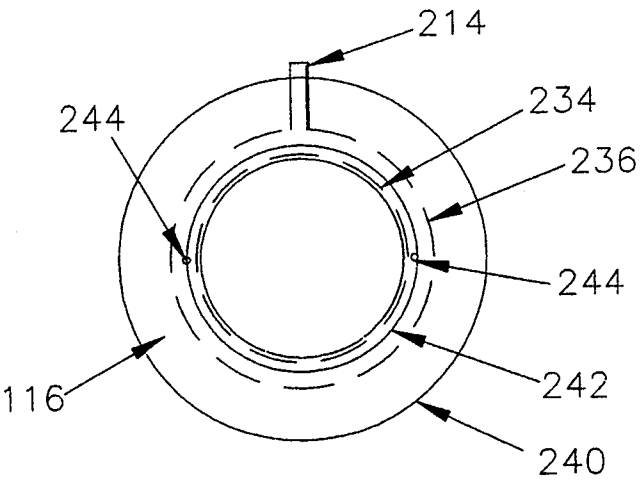

FIG. 2 is a schematic diagram illustrating a preferred embodiment of RRS 10 of this invention. For the sake of simplicity, source 12 of the refrigerant to be recovered, reclaimed or recycled has been omitted from the figure. Low stage assembly 14, shown generally on the left-hand side of FIG. 2, is coupled to source 12 to be evacuated through inlet assembly 20. Inlet assembly 20 includes a vapor inlet valve 40 coupled directly to the source of the refrigerant to be recovered. Valve 40 is coupled at an opposite end by a conduit 42 to an inlet pressure regulator 44 preferably set at 30 pounds per square inch gage (PSIG) to prevent the refrigerant within source 12 from overpressuring low stage assembly 14. Following inlet pressure regulator 44, conduit 42 includes an inlet solenoid valve 46 controlled by a low pressure switch 48. When switch 48 senses a negative pressure or vacuum, for example 15 inches mercury (IN. HG), most of the refrigerant therein has been received by assembly 10 and solenoid valve 46 closes conduit 42. When switch 48 senses a pressure on the order of 10 PSIG, inlet solenoid valve 46 opens. A check valve 50 in conduit 42 following inlet solenoid valve 46 prevents refrigerant received by assembly 10 from flowing back through conduit 42 to source 12.

Downstream of check valve 50, conduit 42 is coupled in fluid communication with suction conduit 70 including an oil separator 52 which is the first element of cleansing assembly 22. It is preferred that cleansing assembly 22 include at least one oil separator 52 coupled in series fluid communication with conduit 70 to remove any oil in the refrigerant from source 12. Oil separator 52 may be a conventional separator such as a Model 900 manufactured by Temprite, Inc. of West Chicago, Ill. The oil removed from the refrigerant in conduit 70 by separator 52 is passed through conduit 54 and check valve 56 to a contaminated oil reservoir 58. Oil reservoir 58 includes a high oil switch 60 which shuts down RRS 10 when reservoir 58 is full. The contaminated oil within reservoir 58 may then be drained through a contaminated oil drain valve 62. Reservoir 58 also includes a pressure relief valve 64 to prevent overpressuring of reservoir 58. The gas relieved through the pressure relief valve 64 is returned to the system through conduit 65 and cap tube 67 to prevent any refrigerant discharge to atmosphere. Conduit **70*b* diverging from the top of contaminated oil reservoir 58 is preferably a one-quarter inch outside diameter (OD) copper tube including a capillary tube 84 and terminating at an opposite end in oil reservoir 86**.

Oil reservoir 86 is preferably a pressure cylinder designated Model No. OR-1½ produced by Sporlan Co. of St. Louis, Mo. An oil fill valve 88 is in fluid communication with reservoir 86 at one end, and an opposite end in fluid communication through conduit 90 with oil level control valve 92 attached to compressor 24. Oil level control valve 92 monitors the level of lubricating oil present within compressor 24. When the oil level is low, control valve 92 opens allowing oil to flow from reservoir 86, under pressure from capillary tube 84, into compressor 24.

Downstream of oil separator 52, conduit 70 is coupled in fluid communication to a filter 72 constituting another element of cleansing assembly 22. Filter 72 may contain any one of a variety of filter media, each designed to remove specific contaminants. For example, the filter media within filter 72 may be designed to remove water, wax, corrosive acid, or other compounds contaminating the refrigerant drawn from source 12. A pressure gauge 74 in fluid communication with suction filter 72 may be used to provide an indication of the amount of suction pressure placed on conduit 70.

Downstream from suction filter 72 conduit 70 includes a crankcase pressure regulator 76 substantially identical to inlet pressure regulator 44, and also set at 30 PSIG. From crankcase pressure regulator 76, conduit 70 passes through a vibration eliminator 78 before terminating at a suction service valve 80 attached to recovery compressor 24. Conduit 70, extending from the junction of conduit 42 to suction service valve 80, is preferably five-eighths inch OD copper tubing.

The refrigerant drawn into RRS 10 through suction conduit 70 by compressor 24 is compressed therein and discharged through service valve 94 into conduit 96 terminating in pump-out valve 98. Conduit 96 includes a plurality of curved portions which act together to provide a vibration eliminator 100 separating the high-pressure side of assembly 14 from the vibration produced by recovery compressor 24. In a similar fashion, vibration eliminator 78 separates the low pressure or suction side of assembly 14 from the same vibrations.

From pump-out valve 98, conduit 96 diverges forming high-pressure lines 102 and 104. High pressure line 102 extending from pump-out valve 98 intersects bypass valve 106, interconnecting high-pressure lines **102*a* and 102*b*. Conduit 102*b* contains several loops which are interconnected by a plurality of metal fins to form radiator 108. Down-stream from radiator 108, conduit 102*b* is rejoined with conduit 102*a* to form conduit 102 which is in fluid communication with a second oil separator 110 of cleansing assembly 22. In a similar fashion to oil separator 52, separator 110 removes lubricating oil introduced into the high-pressure refrigerant by compressor 24 and discharges the oil through conduit 112 and check valve 114 to conduit 54 in fluid communication with the contaminated oil reservoir 58 described earlier. It is preferred that conduits 96, 102 and 102*a*, 102*b* be made from three-eighths inch OD copper tubing. Conduit 112, extending from separator 110 to contaminated oil reservoir 58, is preferably a one-quarter OD copper tubing, as is conduit 54 extending from separator 52 to contaminated oil reservoir 58. Radiator 108, designed to remove heat from the high-pressure, high-temperature refrigerant passing through conduit 102*b*, forms the first portion of heat exchange assembly 26. Radiator 108 will also condense any refrigerant additives such as Pentane, Hexane, or R-12 from the low temperature refrigerants and removed from the system through the oil separator 110. These additives will be discharged out of the oil separator 110 through conduit 112 and check valve 114 to conduit 54 in fluid communication with the contaminated oil reservoir 58. Radiator 108 is bypassed by conduit 102*a*** when easily condensed refrigerants such as R-12, R-22 and R-502 are recovered, reclaimed and/or recycled.

Downstream from oil separator 110 through conduit 116 and check valve 117 is the second element of heat exchange assembly 26 wherein conduit 116 is concentrically disposed within a second conduit 118 forming a tube-in-tube or shell and tube (FIGS. **3*a*–3*c*) heat exchanger shown schematically as 120. Check valve 117 prevents the high temperature refrigerants such as R-12, R-22, and R-502, from backing up into the oil separator 110 and being discharged into the contaminated oil reservoir 58 during the pump-out procedure described below. After exiting heat exchanger 120, conduit 116 is coupled in fluid communication with drier 122 comprising the fourth element of cleansing assembly 22. Drier 122 contains a discharge pressure gauge 124 for monitoring the pressure within conduit 116 and drier 122. From drier 122, conduit 116 includes a liquid solenoid valve 126 followed by a check valve 128, and a hose assembly 129 terminating in a liquid inlet valve 130. Hose assembly 129 is detachable from liquid inlet valve 130 via a quick disconnect coupler preferably manufactured by Aeroquip Corporation of Jackson, Mich. Liquid inlet valve 130 is coupled to a cylinder valve manifold 132 coupled to recycle cylinder 134**.

Figure 4A:
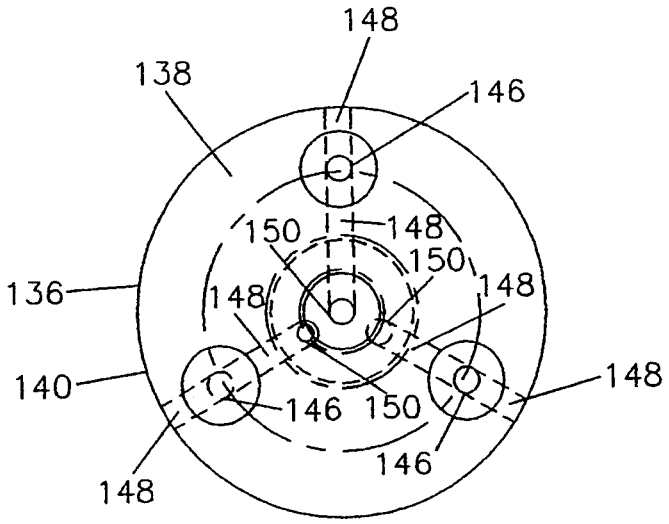
FIGS. 4A and 4B generally illustrate a preferred embodiment of a storage cylinder manifold for use in the invention.
Figure 4B:
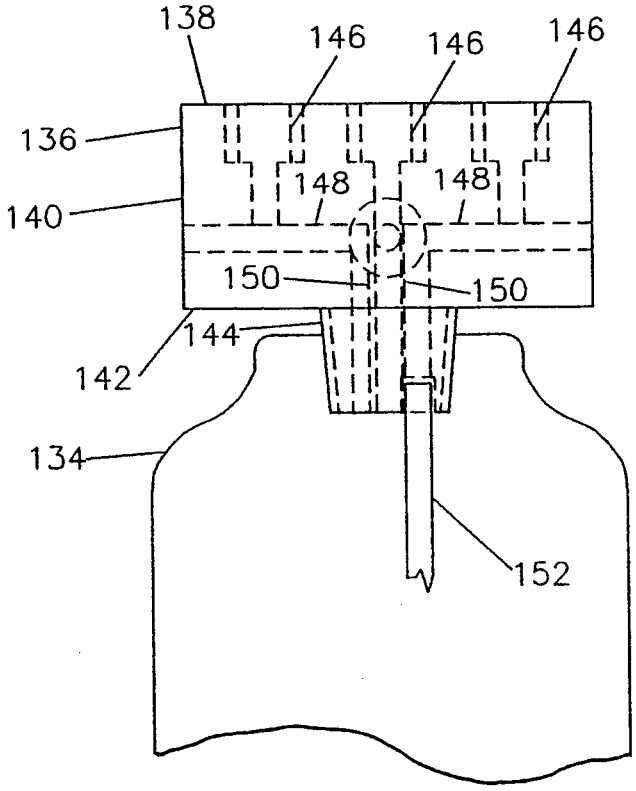

Referring briefly to FIG. 4, cylinder valve manifold 132 includes a cylindrical steel body 136 having an upper surface 138, a perimeter or circumferential surface 140 and a lower surface 142. Extending from lower surface 142, and concentric with body 136, is a threaded neck 144 threadably received by the open end of a storage cylinder 134. Located radially about upper surface 138 and equidistant from each other are a plurality of holes 146 each having a threaded inner wall and adapted to receive a valve such as liquid inlet valve 130 shown in FIG. 2. Each valve is generally known as a cylinder shut-off valve such as Model 965 produced by Henry Valve Co. of Melrose Park, Ill. Intersecting the bottom of holes 146 and extending radially in from perimeter 140 are passages 148 which terminate in holes 150 bored in through threaded neck 144. The ends of passages 148 terminating in the perimeter 140 are plugged either by welds or threaded plugs well-known in the art. In this manner, each hole 146 extending through upper surface 138 is in fluid communication with a respective hole 150 extending through neck 144 through a dedicated passage 148. At least one hole 150 in neck 144 is fitted with a dip tube 152 of sufficient length to extend to the bottom of recycle cylinder 134. It is preferred that the diameter of cylinder valve manifold 132 be less than the inside diameter of the cap required by the United States Department of Transportation to protect the top of pressurized cylinders such as 134.

Referring again to FIG. 2, a vapor outlet valve 154 similar to inlet valve 130, is coupled in fluid communication with a conduit 156 having a suction solenoid valve 158 and an evaporator pressure regulator valve 160 coupled in series fluid communication therewith. Downstream from evaporator pressure regulator valve 160, conduit 156 is coupled in fluid communication with suction conduit 70 at junction 162.

Interconnected to dip tube 152 in recycle cylinder. 134, through liquid outlet valve 182, is conduit 184. Conduit 184 includes in series a recycle solenoid valve 186 followed by a recycle expansion valve 188 before terminating at junction 190 with conduit 206 forming the outer portion of recycle heat exchanger 208. Expansion valve 188 includes an equalization line 189 interconnected to conduit 206 and a thermobulb 192 adjacent and strapped to conduit 206 to sense temperature variations therein and communicate such variations to recycle expansion valve 188. It is preferred that recycle conduit 184 be made from a three-eighths inch OD copper tube joined with the one-half inch OD conduit 206 forming recycle heat exchanger 208. The outlet side of conduit 206 is interconnected with suction conduit 70 at Junction 162. Coupled to conduits 184 and 206 at junction 190 is a third conduit 194 including a liquid recovery capillary tube 196 and terminating at an opposite end in a liquid inlet valve 198.

Interconnecting high-pressure conduit 116 at Junction 164 with suction conduit 70 at junction 166 is pressure relief system 30 including a conduit 168 extending from junction 164 and coupled to a vapor tank 170, and a second conduit 172 extending from tank 170 to conduit 70 at junction 166. Disposed in conduit 168, between junction 164 and vapor tank 170, is a vapor tank solenoid valve 174 while a vapor tank capillary tube 176 is disposed in-line with conduit 172. Conduits 168 and 172 are coupled in fluid communication with vapor tank 170 through inlet port 178 and outlet valve 180.

Shown on the right-hand side of FIG. 2 is high stage assembly 18. High stage assembly 18 includes a compressor 32 coupled through discharge service valve 200 to a high-pressure conduit 202 containing a plurality of curved bends to form vibration eliminator 204 similar to that indicated by reference numeral 100. From vibration eliminator 204, conduit 202 passes concentrically through a second conduit 206 in heat exchange relationship to form recycle heat exchanger 208 comprising a portion of heat exchange assembly 26. Exiting recycle heat exchanger 208, high-pressure conduit 202 passes in a serpentine fashion through condenser 34 having at least one condensing fan 210, each run by a condenser fan motor 212. It is preferred that high-pressure conduit 202 extending from discharge service valve 200, through recycle heat exchanger 208 and condenser 34, be made from three-eighths inch OD copper tubing.

Extending from condenser 34, conduit 214 interconnects condenser 34 through thermal expansion valve 218 with an evaporator forming the outer portion of heat exchanger 120. A filter drier 216 may also be located in conduit 214. Interconnecting high stage evaporator 36 with suction service valve 222 on compressor 32 is conduit 220 through a vibration eliminator 224 similar to vibration eliminator 78 in low stage assembly 14.

It is preferred that conduit 214 interconnecting condenser 34 with high stage evaporator 36 be a one-quarter inch OD copper tube. It is also preferred that conduit 220 interconnecting high stage evaporator 36 with suction service valve 222 have an outside diameter of five-eighths inch and also be made from copper tubing. Thermal expansion valve 218, disposed in line with conduit 214, includes a thermobulb 226 mounted to the exterior of conduit 220 for reasons well known in the art.

FIGS. *3a–3c* are section views illustrating a preferred embodiment of heat exchanger 120 including an inner cylinder 230 concentrically disposed within an outer cylinder 232. Inner and outer cylinder 230, 232, respectively, are interconnected at each end by top and bottom plate 238, 240, respectively, to form volume 242 and high-stage evaporator 36. Conduits 214 and 220 entering and leaving condenser 36 are shown passing through outer cylinder 232. Passing through end plate 240 and disposed in cylindrical volume 242 is conduit 116. Within volume 242, conduit 116 is comprised of one conduit 244, wrapped in a coil within volume 242 so as to provide maximum surface area in volume 242. The outlet portion of conduit 244 also extends through plate 240 at the bottom of evaporator 36. Conduit 244 is approximately a 70-foot, 6-inch length of three-eighths OD copper tubing coiled within volume 242.

It is preferred that recycle cylinder 134 be concentrically received by cylinder 230 and that the inside diameter of inner cylinder 230 fit substantially close to the outside diameter of recycle cylinder 134. Cylinder 134 extends from top plate 238 and bottom plate 240 with the bottom of cylinder 134 resting on a weight-sensing device 248 located immediately below and adjacent bottom plate 240. It is also preferred that the exterior surfaces of cylinders 230, 232 and plates 238, 240 be plated to inhibit corrosion. As will become readily apparent from the discussion below, recycle cylinder 134 will be chilled by heat exchanger 120 surrounding recycle cylinder 134. The chilling or cooling effects of heat exchanger 120 on recycle cylinder 134 are maximized by the close tolerance of the inner cylinder 230.

Figure 5:
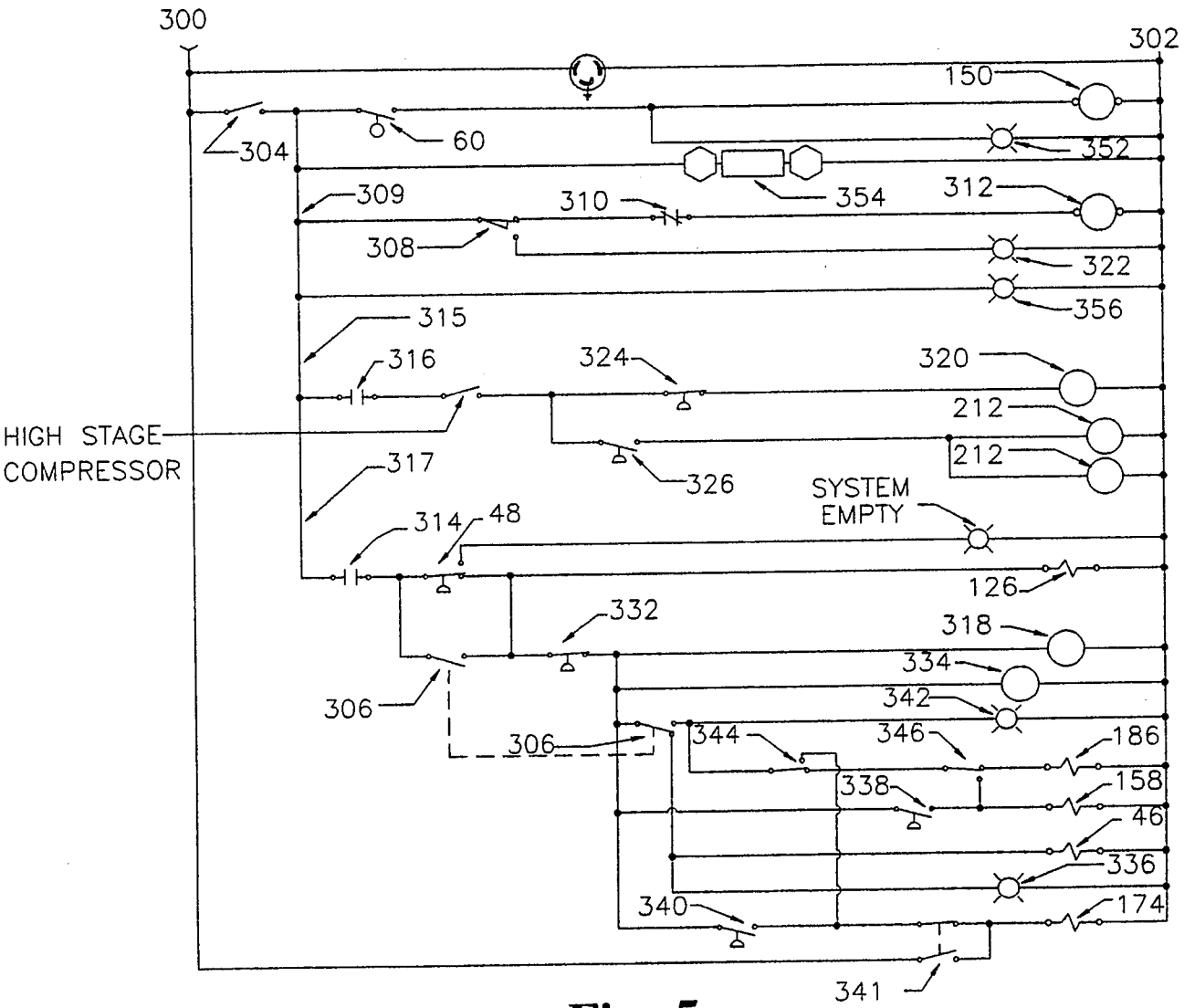
FIG. 5 is an electrical schematic diagram of the invention.

FIG. 5 is an electrical schematic diagram illustrating the circuit used to control RRS 10. Recovery and recycling system 10 is preferably powered by a 230 V, single phase 60 Hertz (Hz) power source coupled through lines 300, 302. A power switch 304 is used to energize RRS 10 by the operator once RRS 10 is coupled to source 12. The operator selects the recovery mode through selector switch 306. For the purpose of this discussion, it will be assumed that RRS 10 is empty and will recover refrigerant from source 12.

Upon the application of power, weight-sensing device limit switch 308 on line 309, which is normally in the closed position, supplies power through relay contacts 310 to control relay 312 operably coupled to activate relay contacts 314 and 316 in lines 315 and 317, respectively. Control relay 312 is preferably a magnetic coil relay, which upon receiving an electrical signal from lines 300 and 302, causes relay contacts 314 and 316 to close. If limit switch 308 is tripped, indicating that recycle cylinder 134 is full, the electrical power is removed from relay 312, opening relay contacts 314 and 316 and interrupting current to recovery compressor motor 318 and high stage compressor motor 320. Tripping of limit switch 308 causes indicator light 322 to illuminate indicating recycle tank 134 is full.

With relay contact 316 closed, power is provided across high-pressure switch 324 which is coupled in fluid communication to the discharge side of high stage compressor 32, to provide power to high stage compressor motor 320. High-pressure switch 324 is designed to trip at 300 PSIG and be reset manually. This prevents overpressuring of high stage assembly 18. In order to control pressure therein, a fan cycle switch 326 is also coupled in fluid communication to the discharge side of compressor 32 to activate condenser fan motors 212 when the discharge pressure reaches 225 PSIG and cut out when discharge pressure reaches 200 PSIG. The function of the high stage assembly remains essentially the same whether RRS 10 recovers or recycles refrigerant.

When relay contact 314 is closed by relay 312, and selector switch 306 is in the recovery mode, low pressure switch 48 in inlet conduit 42 (FIG. 2) remains normally closed while the pressure in conduit 42 is 10 IN. HG or greater. A closed low pressure switch 48 provides power across high-pressure switch 332 to recovery compressor motor 318, optional running time meter 334, inlet solenoid 46, recovery lamp 336, and storage cylinder solenoid 126. Suction solenoid valve 158 and vapor tank solenoid valve 174 are also opened by high-pressure switches 332, 340, respectively. If the discharge pressure reaches 375 PSIG, switch 332 opens, disabling recovery compressor 24 (FIG. 2). Switch 332 automatically resets. If the discharge pressure in compressor 24 (FIG. 2) reaches 250 PSIG, the high pressure switch 340 closes and vapor tank solenoid 174 is opened to relieve the pressure in discharge lines 102, 116 into tank 170. When the pressure drops to 225 PSIG or lower, the high pressure switch 340 opens and solenoid valve 174 closes. Similarly, when discharge pressure reaches 275 PSIG, the high pressure switch 338 closes and suction solenoid 158 opens, drawing vapor from recycle cylinder 134 into conduits 156 and 70. Suction solenoid closes when discharge pressure reaches 225 PSIG or less. Thus, switches 332, 338 and 340 are continuously balancing operating pressure levels in system 10 which prevent rupturing and overloading of RRS 10, as well as aid in chilling and condensing the recovered refrigerant.

In the recycle mode, the operator moves selector switch 306 to recycle, which causes inlet suction solenoid valve 46 to close and deactivates low pressure switch 48 in conduit 42. The closing of solenoid valve 46 prevents recovered refrigerant from inadvertently reentering source 12. The closing of solenoid valve 46 also prevents air from inadvertently being drawn into the RRS 10 and prevents the inlet suction solenoid 46 from burning out since no refrigerant will be flowing. Selection of the recycle mode through switch 306 turns off recovery/reclaim indicator lamp 336 and lights recycle indicator lamp 342 to provide a visual indication to the operator as to the mode of operation. Recycle mode also causes recycle solenoid valve 186 to open when the pump-out Switches 344 and 346 are in the normal position.

Other systems which are activated, regardless of the selected mode of operation, are control relay 150 through liquid level switch 60 disposed in contaminated oil reservoir 58. Control relay 150 is preferably a magnetic coil relay, which upon receiving an electrical signal from lines 300 and 302, with oil level switch 60 tripped and switch 304 closed, will open relay contacts 314, 316, effectively shutting down RRS 10 until the contaminated oil in reservoir 58 has been emptied. Liquid level 60 will also illuminate an oil level indicator lamp 352. Other circuits which are actuated upon the powering up of RRS 10 include the weight-sensing device readout 354 and power-on indicator 356.

Equalization switch 341 is used at the end of the pump-out cycle. At the end of the pump-out cycle, the suction side is in a vacuum and the discharge side may be at 250 PSIG. With the power switch 304 OFF, the operator will put equalization switch 341 in the ON position. This will allow current to flow to the vapor tank solenoid 174 and cause it to open. The equalization switch will also open the circuit, preventing the current from back feeding to the rest of the circuits through the high pressure switch 340. When the vapor tank solenoid 174 is opened, the refrigerant remaining in conduits 102, 116, will flow through conduit 168, vapor tank solenoid 174, inlet port 178 into the vapor tank 170. From the vapor tank, the refrigerant will flow out through the outlet valve 180, through conduit 172, cap tube 176, and into conduit 70 at junction 166. This will break the vacuum on the suction side and allow the discharge and suction sides to equalize to about atmospheric pressure. The system empty indicator tells the operator that the system being serviced is empty.

To recover refrigerant from source 12 (FIG. 2), the operator locates recycle cylinder 134 in heat exchanger 120. The recycle cylinder is preferably fit with cylinder valve manifold 132 having conduits 129, 156 and 184 coupled in fluid communication therewith through liquid inlet valve 130, vapor outlet valve 154 and liquid outlet valve 182. It is preferred that the couplings of conduits 129, 156 and 182 to valves 130, 154 and 182, be made using quick connect fittings such that when coupled to each valve the fittings allow fluid to pass therethrough and when disconnected, close off each conduit preventing any fluid therein from flowing to the atmosphere. Once the connection of each conduit is made to each valve, each valve is opened to place each conduit in fluid communication with recycle cylinder 134.

Referring to FIGS. 1–5, recovery and recycling system 10 is coupled to source 12 of refrigerant to be recovered and/or recycled. Typically, source 12 is a nonfunctioning refrigeration system such as a deep freezer or environmental chamber. Source 12 may also be a tank of refrigerant already recovered from a refrigeration system. Vapor inlet valve 40 of low stage assembly 14 is coupled to source 12 to enable transfer of the refrigerant from source 12 into assembly 10. Also, at this point, it is preferred that all solenoid valves, and particularly inlet solenoid valve 46, be in the closed position, preventing the migration or flow of refrigerant within system 10. At this point, the operator selects which task is to be performed. For the purpose of this discussion, it will be assumed that low stage assembly 14 is generally empty and that refrigerant will be recovered from source 12.

To recover refrigerant from source 12, the operator connects RRS 10 to a source of electrical current, preferably a 230 volt, single phase, 60 Hz source, unless the unit has the 460/230 volt option. The operator energizes RRS 10 by depressing power switch 304 (FIG. 5) which provides power to substantially all of the components comprising RRS 10. The operator selects the recovery mode through selector switch 306. If a pressure of 10 PSIG or greater is present in conduit 42 after opening valve 40, low pressure switch 48 opens liquid solenoid 126 and solenoid 46. Because the discharge pressure in compressor 24 is less than 250 PSIG, suction solenoid 158 and vapor tank solenoid valve 174 are in the closed position. Simultaneously, high-stage assembly 18 begins to circulate refrigerant such as R-12, R-22 or R-502 through its system to cool conduit 116 in exchanger 120. Refrigerant from source 12 enters through inlet valve 40 as a vapor and passes into inlet pressure regulator 44 which reduces the pressure of the refrigerant entering therein to a system pressure of no more than 30PSIG. The low pressure switch 48 monitors the pressure within conduit 42. If the pressure drops below a vacuum of 15 IN. HG, solenoid valve 46 is closed. Such a pressure value would indicate that source 12 is substantially evacuated and that no additional refrigerant is available.

The vapor flowing through conduit 42 enters conduit 70 and passes through oil separator 52 wherein oil contained therein is removed and passed through conduit 54 and check valve 56 to contaminated oil reservoir 58. Oil separator 52 is designed to remove substantially all of the oil in the refrigerant in conduit 70. As is well known, when a compressor burns out, the lubricating oil becomes acidic and is undesirable in an operating compressor. It is therefore preferred that the contaminated or acidic oil be removed from the refrigerant prior to being recovered and/or recycled.

The oil free refrigerant is then passed back into conduit 70 where it is passed through suction filter 72. The operator may then monitor the suction on conduit 70 through suction pressure gauge 74 in fluid communication with suction filter 72. Suction filter 72 contains any one of a variety of filter media designed to be contaminant specific, cleansing the refrigerant of that particular contaminant.

The refrigerant passing through suction filter 72 is passed into conduit 70. The refrigerant in conduit 70 is then passed through a crankcase pressure regulator 76, also set at the system pressure of 30PSIG, and through a vibration eliminator 78 before being introduced to compressor 24 through suction service valve 80. Vibration eliminator 78 prevents the transfer of vibrations produced by compressor 24 into suction conduit 70.

Compressor 24, receiving the vapor or gaseous refrigerant through conduit 70, compresses the refrigerant into a high-pressure, high-temperature vapor through discharge valve 94 and into conduit 96. Conduit 96 contains several loops and bends which act as a vibration eliminator 100 to separate the remainder of the system from the discharge side of compressor 24. The high-pressure, high-temperature refrigerant is then passed from conduit 96 through pump-out valve 98 and into conduit 102.

When low-temperature refrigerants such as R-13, R-23 and R-503 are being recovered, bypass valve 106 is set to direct the refrigerant in conduit 102 into conduit **102*b* where the high temperature of the refrigerant is reduced generally to ambient temperature by the transfer of heat through radiator 108. The now high-pressure, ambient temperature refrigerant is passed through oil separator 110 designed to remove the oil introduced therein by compressor 24. The separated oil is transported through conduit 112 and check valve 114 into conduit 54 and into contaminated oil reservoir 58**.

Because the oil is removed from the refrigerant by separators 52 and 110, the oil level within compressor 24 is being depleted. Oil is replenished to compressor 24 through clean oil reservoir 86 through conduit 90 and oil level control valve 92. The oil is forced from reservoir 86, through conduit 90 and valve 92 by system pressure exerted capillary tube 84 in conduit **70*b*. Clean oil is added to reservoir 86 through an oil fill valve 88 coupled in fluid communication to reservoir 86. If contaminated oil reservoir 58 becomes full, a high oil switch 60 shuts down the system and provides an indication to the operator that contaminated oil reservoir 58 needs to be drained through oil drain valve 62. If, for some reason, high oil switch 60 malfunctions, a pressure relief valve 64 is provided to relieve the pressure within reservoir 58** and returns to the suction side of the compressor.

Referring back to oil separator 110, the refrigerant passed through separator 110 is discharged into conduit 116, check valve 117 and transported to heat exchanger 120 where conduit 116 becomes conduit 244, forming coil 248 within volume 242 of evaporator 36. Within conduit 244, the high-pressure, ambient-temperature refrigerant transfers heat to the refrigerant boiling within volume 242 of evaporator 36. Refrigerant such as R-12, R-22 and R-502 enters evaporator 36 through conduit 214 and boils within volume 242, absorbing heat transferred from the high-pressure, ambient-temperature refrigerant passing through coil 248. The high-stage refrigerant boiling within volume 242 then exits, or is discharged, through conduit 220 and returned to compressor 32 in high stage assembly 18. The heat absorbed by the refrigerant in volume 242 of evaporator 36 causes the refrigerant in conduit 244 to cool and condense to a high-pressure, low-temperature liquid refrigerant which is then passed through the opposite end of conduit 244 to converge into conduit 116 exiting evaporator 36. The now liquid refrigerant is passed through drier 122 where any contaminants are removed. The liquid refrigerant is then passed through conduit 116, liquid solenoid valve 126 and check valve 128 before being passed through liquid inlet valve 130, cylinder valve manifold 132 and into recycle cylinder 134.

As mentioned earlier, recycle cylinder 134 is concentrically disposed within inner sleeve 230 of heat exchanger 120. The expansion of the high stage refrigerant within volume 242 also cools recycle cylinder 134. To further draw down the temperature of recycle cylinder 134 and maintain the low-temperature refrigerant in a liquid state, vapor within recycle cylinder 134 is periodically drawn off through vapor outlet valve 154 into conduit 156. When the discharge of compressor 24 reaches approximately 275 PSIG, suction solenoid 158 is opened, placing conduit 156 in fluid communication through evaporator pressure regulator (EPR) valve 160 with suction conduit 70. Compressor 24 is then able to draw directly from recycle cylinder 134 to draw off the vapor formed therein by the flashing of the liquid refrigerant deposited through conduit 116. Drawing off the vapor in recycle cylinder 134 results in a pressure drop, causing additional refrigerant to boil and absorb heat resulting in a further temperature drop of the refrigerant within cylinder 134. Suction solenoid 158 closes when the discharge pressure in compressor 24 reaches approximately 225 PSIG. With the additional cooling of recycle cylinder 134 by discharging vapor through suction solenoid 158, the liquid refrigerant naturally flows to its coolest point formed in recycle cylinder 134.

When the pressure in conduit 116 interconnecting oil separator 110 with heat exchanger 120 reaches approximately 250 PSIG, vapor tank solenoid valve 174 opens drawing a portion of the high-pressure, ambient temperature refrigerant from conduit 116 through conduit 168 and inlet port 178 to vapor tank 170. The volume of vapor tank 170 receiving the high-pressure, ambient temperature refrigerant is sufficient to reduce the pressure in conduit 116 to below approximately 225 PSIG. At that point, vapor tank solenoid 174 closes. The vapor present within vapor tank 170 is then drawn slowly through outlet valve 180, conduit 172 and is discharged through vapor tank capillary tube 176 into suction conduit 70 where it is recleansed through suction filter 72 and recompressed by compressor 24. Through suction solenoid 158, and vapor tank solenoid valve 174, system pressure on the high side or pressurized side of compressor 24 is maintained in order to convert as much refrigerant from a gaseous or vapor state to a liquid state as possible.

The amount of liquid refrigerant in recycle cylinder 134 is determined by the weight of cylinder 134 on weight-sensing device 135 (FIG. 2). The tare weight of recycle cylinder 134 is determined when first inserted into heat exchanger 120. Weight-sensing device 135 then measures the weight of the refrigerant added to cylinder 134. At a predetermined value specific to the size of cylinder 134 being used, scale limit switch 308 shuts down compressors 24 and 32 and closes all solenoid valves in low stage assembly 14. The operator may then remove recycle cylinder 134 from system 10 and return it to the manufacturer for reclamation, or he may recycle the refrigerant contained within cylinder 134 in the recycling method provided by assembly 10. If the operator elects to simply reclaim or store the refrigerant contained within cylinder 134, the operator disconnects conduits 116, 156 and 184 using the quick disconnects from valves 130, 154 and 182. Cylinder valve manifold 132 and valves 130, 154 and 182 may then be protected by a well-known cap threaded onto cylinder 134 and the cylinder may be shipped to the refrigerant manufacturer or other party to reclaim the refrigerant contained therein.

If it is desired to recycle the refrigerant contained within cylinder 134, that is, cleanse the refrigerant and reintroduce it into system or source 12 being serviced, the operator selects the recycle mode by depressing switch 306 on the control panel. For the purpose of the following discussion, the refrigerant has previously been stored in recycle cylinder 134, or has been completely recovered from source 12 and deposited in recycle cylinder 134. Upon selection of the recycling mode, inlet solenoid valve 46 and suction solenoid valve 158 are closed and recycling solenoid valve 186 and liquid solenoid valve 126 are opened. Upon activation of compressor 24, liquid refrigerant is drawn from recycling cylinder 134 through dip tube 152 and liquid outlet valve 182 into conduit 184. Open recycling solenoid valve 186 allows the fluid in conduit 184 to pass to recycling expansion valve 188 where the pressure differential across valve 188 causes the liquid refrigerant to vaporize and begin to boil in conduit 206. Passing through recycle heat exchanger 208, the boiling refrigerant in conduit 206 absorbs heat energy from the compressed high-stage refrigerant passing through conduit 202 on the way to condenser 34. The additional heat supplied to the recycled refrigerant from high-stage assembly 18 in heat exchanger 208 causes it to change to a gas. The gaseous refrigerant is then transported in conduit 206 from recycle heat exchanger 208 to junction 162 with suction conduit 70. Through suction conduit 70, the recycled gaseous refrigerant passes through oil separator 52, suction filter 72, crankcase pressure regulator 76 and vibration eliminator 78 before passing it through service valve 80 at compressor 24. The pressure in the contaminated oil reservoir 58, from oil being deposited into it from oil separators 52 and 110, will pressurize the clean oil reservoir 86 for providing lubricating oil through conduit 90 to oil control 92.

Compressed by compressor 24, the recycled refrigerant is discharged through service valve 94 into conduit 96 forming vibration eliminator 100. Pump-out valve 98 directs the refrigerant into conduit 102 and to bypass valve 106 where heat is removed by passing the refrigerant through radiator 108. Oil and other additives in the refrigerant, such as Pentans and Hexane, added by compressor 24 are removed by passing the refrigerant through separator 110. The recycled refrigerant is then passed through conduit 116, check valve 117 to heat exchanger 120 where it is recondensed into a liquid by high stage assembly 18. The recondensed and recycled refrigerant passes through conduit 116 into drier 122 and back through liquid solenoid valve 126 and check valve 128 into recycle cylinder 134.

The refrigerant drawn from recycle cylinder 134 is taken from the bottom by dip tube 152 while the returned liquid refrigerant is added to the top of the tank through liquid inlet valve 130. This procedure is repeated until the liquid refrigerant has been cycled several times through the recycle cylinder. At periodic intervals, suction solenoid valve 158 is opened to relieve the pressure within recycle cylinder 134, drawing off vapor and cooling the contents of cylinder 134. The vapor is passed through conduit 156, evaporator pressure regulator valve 160 and into suction conduit 70 where it is recompressed and condensed with the remainder of the refrigerant. As in the recovery phase, heat exchanger 120, together with the flashing or drawing off the vapor therein, cools liquid refrigerant to a point to sustain it in a liquid state.

When it is desired to pump out system 10 to change the type of refrigerant being recovered, reclaimed and/or recycled, pump-out valve 98 on the high-pressure side of compressor 24 is changed to route the high-pressure, high-temperature refrigerant through conduit 104 to conduit 129. It is preferred that the pump-out procedure be conducted after recovering and/or recycling a refrigerant so that recycle cylinder 134 is at a temperature to keep the refrigerant in a liquid state. As is well known, refrigerants have a tendency to flow to their coldest point. Thus, the high-pressure, high-temperature, gaseous refrigerant routed through conduit 104 into conduit 116 will flow through liquid inlet valve 130 into recycle cylinder 134. With suction solenoid 158, recycling solenoid 186 and liquid solenoid 126 in the closed position, compressor 24 will draw down all the remaining conduits up to those locations thus creating a negative pressure in the system. After pump-out has been completed and valves 130, 154 and 182 have been closed, the volume of refrigerant contained between discharge service valve 94 and liquid inlet valve 130 is sufficient to bring the remainder of the system to ambient pressure. This is achieved by opening vapor tank solenoid valve 174 by setting equalization switch 341 to the ON position.

Refrigerant recovery and recycling system 10 may also be used to recover high-temperature refrigerants, namely, R-12, R-22 and R-502 refrigerants used in more common refrigeration systems. To recover the high-temperature refrigerant such as those described above, the source of the refrigerant may be coupled to liquid inlet valve 198 coupled in fluid communication with one-quarter inch OD copper tubing 194. Inlet solenoid 46, recycling solenoid valve 186 and suction solenoid valve 158 are in the closed position upon the starting of compressor 24. The high stage refrigerants, typically in a liquid state, are passed through liquid inlet valve 198 into conduit 194 where they are passed through liquid recovery capillary tube 196. Capillary tube 196 creates a pressure drop in conduit 194 and changes the refrigerant to a vapor where it boils or absorbs heat from high stage refrigerant passing in heat exchange relationship though recycle heat exchange 208. Refrigerant in conduit 194 is transported to conduit 206 where it passes through recycle heat exchanger 208 and changes states to a gaseous phase. Gas is then transported by one-half inch OD copper tube 206 to junction 162 where it enters the five-eighths inch OD copper tubing comprising suction conduit 70. The high stage refrigerant is then passed through oil separator 52, suction filter 72 and into conduit 70 where crankcase pressure regulator 76 prevents overpressuring of compressor 24. The pressure in the contaminated oil reservoir 58, caused from oil being deposited into it, will pressurize the clean oil reservoir 86 through conduit **70*b* and cap tube 84. The gaseous high temperature refrigerant is compressed by compressor 24 and discharged through service valve 94 into conduit 96 forming vibration eliminator 100. Pump-out valve 98 directs the high-pressure refrigerant into conduit 102 where bypass valve 106 routes the refrigerant through conduit 102*a*, bypassing radiator 108**.

High-temperature refrigerants such as R-12, R-22 and R-502 are readily condensed by passing the refrigerant through an ambient temperature heat exchanger such as radiator 108. Bypassing radiator 108 allows the refrigerant vapor to enter conduit 102 and pass through oil separator 110 where a substantial portion of the oil introduced therein by compressor 24 is removed and deposited in contaminated oil reservoir 58 through conduit 112. The substantially oil-free vaporous refrigerant then passes through conduit 116 and check valve 117, and enters heat exchanger 120 where it is condensed to a liquid by high stage refrigeration assembly 18. The condensed low-temperature liquid refrigerant is then passed through dryer 122 by conduit 116 and into recycle cylinder 134 through liquid solenoid valve 126, check valve 128 and liquid inlet valve 130. This process is continued until recycle cylinder 134 is substantially full, or high-temperature refrigerant source coupled to liquid inlet valve 198 has generally be drawn down to a vacuum. At this point the operator may elect to either reclaim or recycle the high-temperature refrigerant contained in recycle cylinder 134. If recycling is elected, the procedures, as outlined above, are repeated with the exception that bypass valve 106 directs the high-temperature, gaseous refrigerant through conduit **102*a* instead of conduit 102*b* to prevent condensation of the refrigerant prior to reaching the oil separator 110**. The remaining procedures are carried out in substantially the same manner as described above with respect to low-temperature refrigerants.

Although the invention has been described with respect to specific preferred embodiments thereof, many variations and modifications will become apparent to those skilled in the art. It is, therefore, the intention that the appended claims be interpreted as broadly as possible in view of the prior art to include all such variations and modifications.

The embodiments of the invention in which an exclusive property or privilege is claimed are defined as follows:

1. A method for reclaiming a refrigerant, comprising:
receiving the refrigerant through an inlet;
cleansing contaminants from the refrigerant;
compressing the refrigerant to a heated vapor;
extracting the heat from the heated vapor by passing said heated vapor through first and second heat exchangers, said heated vapor changing states to become a liquid refrigerant, condensed by a second refrigeration system; and
storing said liquid refrigerant in a storage container chilled by at least one heat exchanger.

2. The method of claim 1, further including absorbing pressure spikes occurring in said refrigerant received through said inlet.

3. The method of claim 2, further including drawing vapor from said storage container when the pressure within said container approximates the pressure of said liquid refrigerant entering said container and passing the vapor from the container to said inlet wherein the vapor drawn from said container is compressed and recondensed before returned to said container.

4. The method of claim 3, further including:
drawing liquid refrigerant from said container;
changing the state of said liquid refrigerant to a vapor refrigerant;
cleansing contaminants from said vapor refrigerant;
compressing the vapor refrigerant to a pressurized and heated vapor refrigerant;
extracting the heat from said pressurized and heated vapor refrigerant, changing state from a vapor to a liquid; and
storing the liquid refrigerant in said storage container.

5. The method of claim 1, further including cleansing contaminates from said refrigerant prior to the step of compressing.

6. The method of claim 1, further including removing any lubricant present in the vapor refrigerant after compressing and prior to condensing.

7. A method for removing a refrigerant from a non-functioning refrigeration system and storing the recovered refrigerant for reclaiming or recycling, comprising the steps of:
drawing the refrigerant in from the non-functioning refrigeration system through a regulated inlet;
cleansing contaminants from the refrigerant;
compressing the refrigerant;
removing heat from the compressed refrigerant and condensing it to a liquid by passing the refrigerant in heat exchange relationship with a second refrigeration system; and
storing the liquid refrigerant in a chilled storage container.

8. The method of claim 7, further including:
controlling pressure of the compressed gaseous refrigerant by periodically diverting a portion of said compressed refrigerant to the refrigerant drawn in from the non-functioning refrigeration system.

9. The method of claim 8, further including:

periodically drawing gaseous refrigerant from said storage container;

cleansing contaminants from the gaseous refrigerant from said storage container;

compressing the gaseous refrigerant;

removing heat absorbed by the gaseous refrigerant as a result of compressing and condensing it to a liquid by passing the gaseous refrigerant in heat exchange relationship with said second refrigeration system; and storing the liquid refrigerant in said storage container.

10. The method of claim 9, further including chilling said storage container by placing it in heat exchange relationship with said second refrigeration system to draw additional liquid refrigerant therein and maintain it in a liquid state.

11. The method of claim 10, further including:

weighing said storage container as it receives said liquid refrigerant; and stopping the compression of the refrigerant and condensing to a liquid when said storage container reaches a predetermined weight.

12. The method of claim 7, wherein the step of cleansing contaminants from the refrigerant includes:

separating oil introduced to the refrigerant; and mechanically and chemically filtering other contaminants from the refrigerant.

13. The method of claim 12, further including passing the liquid refrigerant through a drier to remove contaminants therefrom.

14. The method of claim 12, further including:

storing the oil separated from the refrigerant in a contaminated oil reservoir; and interrupting the method once the contaminated oil reservoir reaches a predetermined level.

15. A method for removing, reclaiming and recycling refrigerants, comprising:

receiving the refrigerant in a gaseous state through a regulated inlet coupled in fluid communication with a suction conduct;

cleaning contaminants from the refrigerant passing through said suction conduit from said regulated inlet;

compressing the cleansed refrigerant received from said suction conduit to a pressurized and heated vapor contained in a high-pressure conduit;

extracting the heat from the pressurized and heated vapor in the high-pressure conduit by passing said vapor through first and second heat exchangers, the vapor passing through said second heat exchanger changing states to become a pressurized liquid refrigerant, condensed by a high stage refrigeration system coupled in heat exchange relationship with said second heat exchanger;

storing said liquid refrigerant in a storage container; and absorbing pressure spikes occurring in the high-pressure conduit through a restricted conduit in fluid communication with said suction conduit and said high-pressure conduit.

16. A method for removing a refrigerant from a non-functioning refrigeration system and storing the recovered refrigerant for reclaiming or recycling, comprising the steps of:

drawing the refrigerant in from the non-functioning refrigeration system through a regulated inlet;

cleaning contaminants from the refrigerant;

compressing the refrigerant;

removing heat from the compressed refrigerant absorbed as a result of the step of compressing and condensing it to a liquid by passing the refrigerant in heat exchange relationship with a second refrigeration system;

storing the liquid refrigerant in a chilled storage container;

chilling said storage container by placing it in heat exchange relationship with said second refrigeration system to draw additional liquid refrigerant therein and maintain it in a liquid state;

controlling pressure of the compressed gaseous refrigerant by periodically diverting a portion of said compressed refrigerant to the refrigerant drawn in from the non-functioning refrigeration system;

periodically drawing gaseous refrigerant from said storage container;

weighing said storage container as it receives said liquid refrigerant;

cleansing contaminants from the gaseous refrigerant from said storage container; and stopping the compression of the refrigerant and condensing it to a liquid when said storage container reaches a predetermined weight.

17. A method for removing a refrigerant from a non-functioning refrigeration system and storing the recovered refrigerant for reclaiming or recycling, comprising the steps of:

drawing the refrigerant in from the non-functioning refrigeration system through a regulated inlet;

cleaning contaminants from refrigerant;

compressing the refrigerant;

removing heat from the compressed refrigerant and condensing it to a liquid by passing the refrigerant in heat exchange relationship with a second refrigeration system;

storing the liquid refrigerant in a chilled storage container;

separating oil introduced to the refrigerant; and mechanically and chemically filtering other contaminants from the refrigerant.

* * * * *

UNITED STATES PATENT AND TRADEMARK OFFICE

CERTIFICATE OF CORRECTION

PATENT NO. : 5,359,859
DATED : November 1, 1994
INVENTOR(S) : William J. Bench, et al.

It is certified that error appears in the above-indentified patent and that said Letters Patent is hereby corrected as shown below:

Col. 7, line 19, after "cylinder" delete –.–.

Col. 9, line 64, "Switches" should be –switches–.

Col. 14, line 20, "Pentans" should be –Pentane–.

Col. 15, line 57, "be" should be –been–.

Col. 17, line 41, claim 15, "conduct" should be –conduit–.

Signed and Sealed this

Twenty-sixth Day of December, 1995

*Attest:*

Bruce Lehman

BRUCE LEHMAN

*Attesting Officer*

*Commissioner of Patents and Trademarks*